US005992803A

United States Patent [19]

LeRoux

[11] Patent Number: 5,992,803

[45] Date of Patent: Nov. 30, 1999

[54] CARRIER FOR FLEXIBLE PLASTIC BAGS

[76] Inventor: Paul André LeRoux, 1302 Esplanade 120 N., Redondo Beach, Calif. 90277

[21] Appl. No.: 09/037,576

[22] Filed: Mar. 10, 1998

[51] Int. Cl.[6] ..... B65B 67/04; A45F 5/00; A45F 5/10

[52] U.S. Cl. ..... 248/100; 294/159; 294/170; D9/434

[58] Field of Search ..... 248/99, 95, 100; 294/170, 162, 137, 158, 159, 141, 153, 165

[56] References Cited

U.S. PATENT DOCUMENTS

| | | | |
|---|---|---|---|
| D. 159,141 | 7/1950 | Conrad | D17/5 |
| D. 269,253 | 6/1983 | Gagnon | D9/434 |
| D. 294,559 | 3/1988 | Schwalbach | D9/434 |
| D. 314,150 | 1/1991 | Preciutti | D9/455 |
| D. 336,732 | 6/1993 | Joyner | D9/434 |
| D. 340,863 | 11/1993 | Daigle | D9/434 |
| D. 362,622 | 9/1995 | Van Davelaar | D9/434 |
| 3,537,109 | 11/1970 | Spurrier et al. | 248/95 |
| 3,740,770 | 6/1973 | Villari | 248/95 |
| 3,776,231 | 12/1973 | Holbrook et al. | 248/95 |
| 4,420,178 | 12/1983 | Taylor et al. | 294/158 |
| 5,181,757 | 1/1993 | Montoya | 294/159 |
| 5,393,113 | 2/1995 | Walsh | 294/170 |
| 5,447,259 | 9/1995 | Erickson | 220/759 |
| 5,507,544 | 4/1996 | McQuade et al. | 294/159 |
| 5,509,708 | 4/1996 | Nathan | 294/141 |
| 5,599,052 | 2/1997 | Van Davelaar | 294/159 |
| 5,667,266 | 9/1997 | Gioncanti | 294/170 |

*Primary Examiner*—Ramon O. Ramirez
*Assistant Examiner*—Michael Nornberg
*Attorney, Agent, or Firm*—Goldstein & Canino

[57] ABSTRACT

A plastic bag carrier to be used by an individual for lifting and carrying filled plastic grocery bags from the individual's motor vehicle to a desired location inside the individual's home. The plastic bag carrier comprises a support frame having opposite first and second ends, and a handle opening formed therein between the first and second ends for accommodating insertion of a user's hand. The rigid support frame can be a single piece structure formed from molded plastic material. The support frame includes at least one upwardly and inwardly extending hook integrally molded thereto at each of the first and second ends, about which flexible plastic bags can be hung. In an alternative embodiment, the support frame is provided with two handle openings so as to allow the user to grasp the support frame with both hands.

5 Claims, 2 Drawing Sheets

CARRIER FOR FLEXIBLE PLASTIC BAGS

BACKGROUND OF THE INVENTION

This invention relates to a carrier for flexible plastic bags. More particularly, the invention relates to a carrier which is to be used by an individual for assisting the individual in carrying plastic bags filled with items such as groceries. Further, the invention relates to a bag carrier comprising a support frame provided with a handle opening for accommodate the insertion of a user's hand, and at least one upwardly extending hook integrally molded to the support frame at the opposite ends thereof, about which flexible plastic bags can be hung.

Flexible plastic bags are widely used for transporting grocery goods, particularly, those bags having a pair of handle loops extending upwards from the upper edge of the bags. Most people carry grocery filled plastic bags by grasping the pair of handle loops thereof with their fingers. In order to reduce number of trips necessary to transport all the purchased items from their car to their home, many people opt to carry as many grocery bags in their hands as they are able to lift. When the bags are filled with heavy items such as water, soda and the like, the thin handle loops can compress into the fingers from the cumulative weight of those heavy grocery items, which can cut blood circulation and cause a numbing sensation in their fingers.

Due to the difficulties and unpleasantness encountered while moving groceries from their automobile to desired destinations inside their homes, many people dread grocery shopping. Therefore, there is a need to provide a plastic bag carrier that can simplify the task of bringing groceries from their cars to the kitchen. Such a plastic bag carrier should be simple in construction so as to minimize manufacturing costs, and yet allow shoppers to conveniently lift and carry filled plastic grocery bags from location to location without enduring pain associated with grabbing the handle loops of the bag with the fingers. Moreover, such a plastic bag carrier should be capable of permitting shoppers to carry as many filled plastic grocery bags as they are able to lift, thereby reducing number of trips necessary to transport all the purchased items from the automobile to the kitchen.

SUMMARY OF THE INVENTION

It is an object of the invention to provide a plastic bag carrier which is simple in construction so as to minimize manufacturing costs, and yet allows shoppers to carry filled plastic grocery bags without the necessity of having to use their fingers to grasp the handle loops of the bag.

It is another object of the invention to provide a plastic bag carrier which permits shoppers to carry as many filled plastic grocery bags as they are able to lift, thereby reducing number of trips necessary to transport all the purchased items from their automobile to a desired destination.

It is yet another object of the invention to provide a plastic bag carrier which utilizes a plurality of upwardly extending hooks integrally molded to the support frame at the opposite ends thereof for hanging filled plastic grocery bags.

It is a further object of the invention to provide a plastic bag carrier which utilizes a handle opening formed in the support frame to permit the carrier to be more conveniently lifted and carried from location to location without having to endure the pain associated with the carrying of the grocery bags with one's fingers.

The invention is a plastic bag carrier to be used by an individual for lifting and carrying filled plastic grocery bags from the individual's motor vehicle to a desired location inside the individual's home. The plastic bag carrier comprises a support frame having opposite first and second ends, and a handle opening formed therein between the first and second ends for accommodating insertion of a user's hand. The rigid support frame can be a single piece structure formed from molded plastic material. The support frame includes at least one upwardly and inwardly extending hook integrally molded thereto at each of the first and second ends, about which flexible plastic bags can be hung. In an alternative embodiment, the support frame is provided with two handle openings so as to allow the user to grasp the support frame with both hands.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
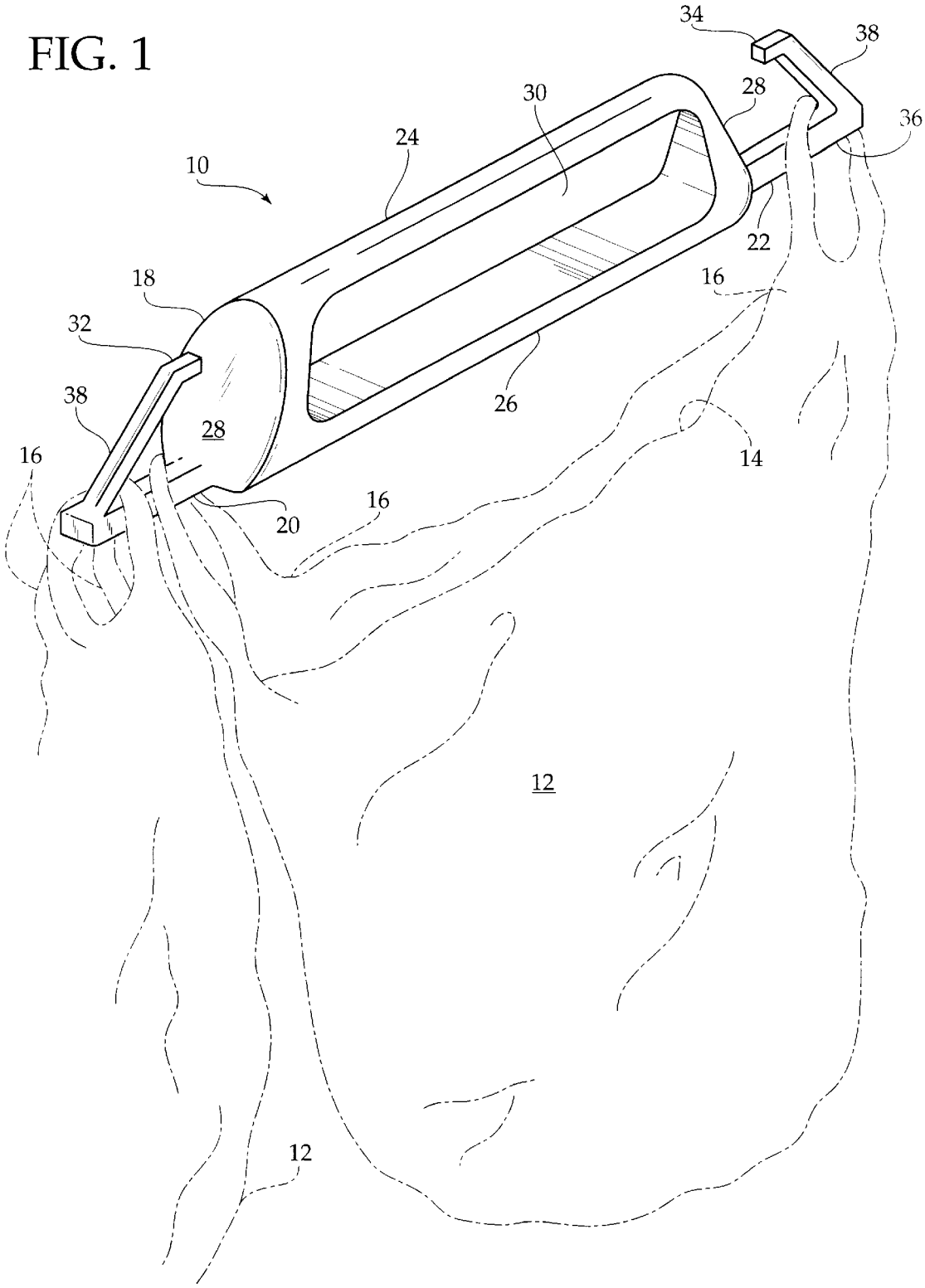
FIG. 1 is a diagrammatic perspective view of the preferred embodiment of the present invention being used to carry filled plastic bags, illustrating the support frame provided with a single handle opening formed therein.

FIG. 1 illustrates the preferred embodiment of a plastic bag carrier 10 in accordance with the principles of the present invention. As will be seen in following paragraphs, the plastic bag carrier 10 is designed to assist a user in lifting and carrying filled groceries bags 12 from the user's automobile to a desired location inside the user's home. For better understanding of the present invention, flexible plastic bags 12 are illustrated having a mouth opening 14, and a pair of flexible handle loops 16 extending upwards from the upper edge of the mouth opening 14 thereof, wherein each of the handle loops 16 is on opposite sides of the bag 12.

The plastic bag carrier 10 comprises a rigid support frame 18 having opposite first 20 and second 22 ends. The rigid support frame 18 can be a single piece structure formed from molded plastic material. The rigid support frame 18 has a durable and strong construction capable of supporting a wide range of grocery bag loads that may be carried thereon. The rigid support frame 18 is defined by an upper support member 24, a lower support member 26, and side support members 28. The support frame 18 is provided with a handle opening 30 therein for accommodating the insertion of a user's hand. The handle opening 30 of the support frame 18 is located between the upper support member 24 and the lower support member 26, and centered along the length of the support frame 18.

The plastic bag carrier 10 further comprises first 32 and second 34 hooks integrally molded to the support frame 18 at the first 20 and second 22 ends adapted to retain the handle loops 16 of the plastic grocery bags 12 so that the grocery bags 12 can be conveniently carried in an upright position when the support frame 18 is lifted by the user. Each of the hooks 32 and 34 includes a horizontal portion 36 extending outwardly from the ends 20 and 22 of the support frame 18 and a slanted portion 38 extending upwardly and inwardly from the horizontal portion 36. The hooks 32 and 34 are sufficiently strong to support relatively heavy grocery bags 12.

The operation of the plastic bag carrier 10 will now be described. To bring groceries from inside an automobile to a desired location inside one's home, the handle loops 16 of the flexible bags 12 are first placed around the hooks 32 and 34 such that the grocery bags 12 are evenly distributed at the first 20 and second 22 ends of the support frame 18. By inserting one's hand through the handle opening 30, the support frame 18 along with the grocery bags 12 retained thereto can be conveniently lifted and carried in an upright position. In this manner, the grocery bags 12 can be easily lifted and carried from location to location without having to endure the pain associated with the carrying of the grocery bags with the fingers.

Figure 2:
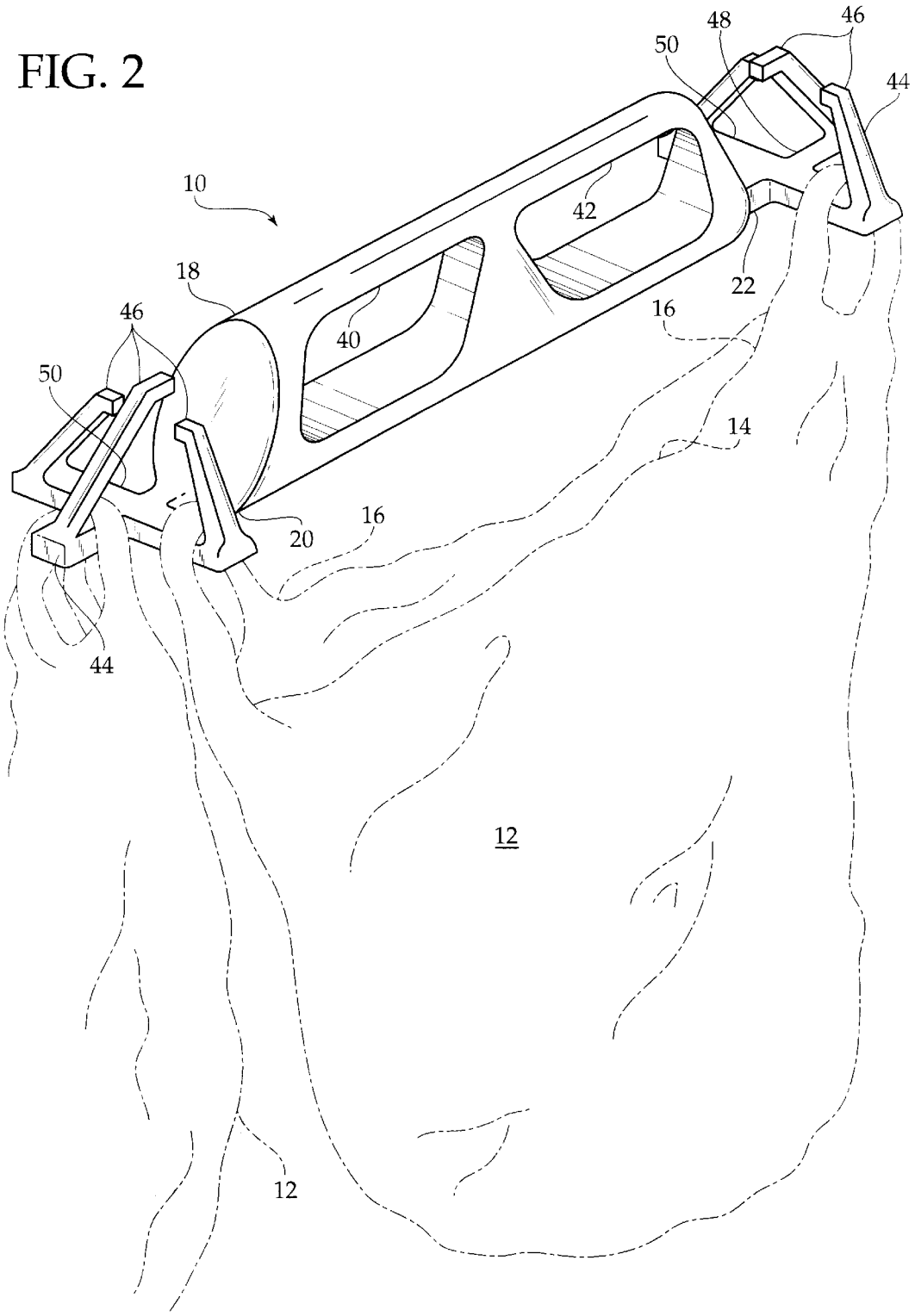
FIG. 2 is a diagrammatic perspective view of an alternative embodiment of the present invention being used to carry filled plastic bags, illustrating the support frame provided with two hand openings formed therein.

FIG. 2 illustrates an alternative embodiment of the plastic bag carrier 10 provided with two handle openings 40 and 42 for accommodating insertion of two hands, thereby allowing the user to grasp the support frame 18 with both hands. In this alternative embodiment, the plastic bag carrier 10 is configured with three hook members 44 integrally molded to the first 20 and second 22 ends of the support frame 18, wherein each hook 46 is adapted to receive and retain the handle loops 16 of grocery bags 12. The three hook member 44 includes a longitudinal portion 48 extending outwardly from the first 20 and second 22 ends of the support frame 18, a lateral portion 50 positioned substantially perpendicular to the longitudinal portion 48, a first hook 46 affixed to the upper surface of the longitudinal portion 48, and second and third hooks 44 affixed to the upper surface of the lateral portion 50.

While the embodiments of the present invention are disclosed in relation to plastic bag carriers 10 incorporating a single hook or a three hook arrangement, it will be appreciated by those skilled in the art that the plastic bag carrier 10 disclosed herein may be easily modified to employ other suitable hook configuration designed to receive and retain the handle loops 16 of the flexible plastic bags 12 as would be appreciated by those skilled in the art. Many specific details contained in the above description merely illustrate some preferred embodiments and should not be construed as a limitation on the scope of the invention. Many other variations are possible.

What is claimed is:

1. A bag carrier for carrying flexible bags in a hanging position, said flexible bags having a pair of handle loops, said bag carrier comprising:

a) a support frame having opposite first and second ends;

b) handle means provided on the support frame between the first and second ends; and c) hook means provided at said first and second ends of said support frame for retaining said handle loops of the flexible bags so that the bags can be conveniently carried in an upright position when said support frame is lifted by a user; wherein the hook means comprises three hook members integrally molded to the support frame at each of the first and second ends, each of said three hook members having a first hook extending upwardly in a longitudinal axis defined by the support frame, and second and third hooks extending upwardly perpendicular to said longitudinal axis, wherein each hook is adapted to receive and retain the handle loops of the flexible bags.

2. The bag carrier as recited in claim 1, wherein the hook means comprises at least one hook affixed to the support frame at each of the first and second ends, wherein each hook is adapted to receive and retain the handle loops of the flexible bags.

3. The bag carrier as recited in claim 2, wherein the handle means comprises a handle opening formed in the support frame for accommodating insertion of a user's hand.

4. The bag carrier as recited in claim 3, wherein the handle means comprises two handle openings formed in the support frame for accommodating insertion of user's both hands.

5. The bag carrier as recited in claim 4, wherein the support frame and the upwardly extending hooks are a single piece structure formed from molded plastic material.

* * * * *